US007802650B2

(12) United States Patent
Bartlett

(10) Patent No.: US 7,802,650 B2
(45) Date of Patent: Sep. 28, 2010

(54) COMBINATION MIDRANGE AND HIGH FREQUENCY HORN

(76) Inventor: John Kevin Bartlett, 3821 Waller Rd E., Tacoma, WA (US) 98443

( * ) Notice: Subject to any disclaimer, the term of this patent is extended or adjusted under 35 U.S.C. 154(b) by 196 days.

(21) Appl. No.: 12/217,702

(22) Filed: Jul. 9, 2008

(65) Prior Publication Data

US 2010/0006367 A1 Jan. 14, 2010

(51) Int. Cl.

| | |
|---|---|
| ***G10K 11/02*** | (2006.01) |
| ***G10K 11/08*** | (2006.01) |
| *G10K 11/18* | (2006.01) |
| *H04R 1/20* | (2006.01) |

(52) U.S. Cl. ..... 181/187; 181/179; 381/342

(58) Field of Classification Search ..... 181/187, 181/179, 185, 188; 381/339, 340, 342
See application file for complete search history.

(56) References Cited

U.S. PATENT DOCUMENTS

| | | | | | |
|---|---|---|---|---|---|
| 2,537,141 | A * | 1/1951 | Klipsch | 181/187 |
| 3,621,749 | A * | 11/1971 | Aluisi | 84/411 R |
| 4,091,891 | A * | 5/1978 | Hino et al. | 181/185 |
| 4,390,078 | A * | 6/1983 | Howze et al. | 181/185 |
| 4,718,517 | A * | 1/1988 | Carlson | 181/159 |
| 4,845,759 | A * | 7/1989 | Danley | 381/97 |
| 5,602,367 | A * | 2/1997 | Meyer | 181/156 |
| 6,009,182 | A * | 12/1999 | Gunness | 381/182 |
| 6,016,353 | A * | 1/2000 | Gunness | 381/342 |
| 6,393,131 | B1 * | 5/2002 | Rexroat | 381/342 |
| 6,513,622 | B1 * | 2/2003 | Gelow et al. | 181/152 |
| 6,981,570 | B2 * | 1/2006 | Dalbec | 181/182 |
| 7,299,893 | B2 * | 11/2007 | Meyer et al. | 181/188 |
| 2004/0216948 | A1 * | 11/2004 | Meyer et al. | 181/188 |
| 2009/0046875 | A1 * | 2/2009 | Masuda | 381/152 |
| 2010/0032233 | A1 * | 2/2010 | Moore | 181/152 |

FOREIGN PATENT DOCUMENTS

JP 10066183 A * 3/1998

* cited by examiner

*Primary Examiner*—Edgardo San Martin

(57) ABSTRACT

A middle frequency horn and high frequency horn assembly having a straight pathway with a shared unitary terminus defined by shared side walls which approach a perpendicular angle compared to the horn axis. The two air columns are separated and partially defined by an internal horizontal baffle in which the top and bottom surfaces are angled to decrease in vertical separation in both upward and downward directions starting from the vertical distance between the respective throat openings and decreasing in separation while progressing toward the mouth, where the angled surfaces intersect and terminate the baffle substantially proximate to the horn mouth.

10 Claims, 1 Drawing Sheet

COMBINATION MIDRANGE AND HIGH FREQUENCY HORN

BACKGROUND OF THE INVENTION

The present invention relates to high frequency loudspeaker horns. More specifically, it relates to separate midrange and high frequency horns combined into a single unified unit.

Recent developments in coaxial and/or extended frequency range compression drivers promote the use of a single horn for loudspeakers, however, such horn drivers tend to be prohibitively expensive. Experience with a horn using the tractrix expansion formula has proven to be a good design choice in that it propagates an extended high frequency response without the tendency to "beam". The use of a single horn for upper frequency reproduction is preferable to using multiple frequency-divided horn and driver combinations as the single horn application presents a single-point acoustic source to the audience, especially when the driver diaphragms are aligned vertically in relation to each other.

A benefit of using separate drivers is that it allows for a wider range of drivers to be selected by price and performance, providing an economic advantage compared to the limited selection and more expensive presented by the coaxial and/or extended range driver. One drawback to the traditional use of two or more separate horn/driver combinations is that typically little attention is paid to the vertical alignment of the diaphragms of the different driving units such as when both horns are mounted on a singe baffle. The difference in overall horn pathway length due to the difference in frequency ranges of the frequency-limited and/or frequency-divided horns and drivers generally is the cause when such horns are flange mounted on a single baffle. Considering the desirability of the single point-source propagation characteristics presented by wide-range coaxial horn drivers and/or single extended-frequency range drivers used in a single horn, a method that provides an alternative to the requirement of using the more expensive wide-range drivers such as employing separate limited-frequency range drivers that are mounted to a single horn in a "time-aligned" manner would be a viable and more economical approach.

The formulas for determining the tractrix flare rate are well known in the art. The magazine article "The Tractrix Horn Contour", by Bruce C. Edgar, Speaker Builder magazine, February 1981, and another article by the same author titled "The Edgar Midrange Horn", Speaker Builder magazine, January 1986, are two examples which have served to rekindle interest in the tractrix flare rate.

It is therefore desirable to produce a wide bandwidth horn device employing a single tractrix midrange horn in combination with a tractrix high frequency horn in a single integrated unit which provides a time-aligned performance characteristic and further promotes a wider selection of potential drivers to be easily and economically realized.

SUMMARY OF THE INVENTION

It is an object of the present invention to provide an approximate vertical alignment capability between the midrange and high frequency driver diaphragms.

An additional object of the invention is to provide increased versatility in mounting applications, specifically, the ability to perform with or without a front baffle mounting, as in a free-standing application.

A further object of the invention is to provide the same horizontal dispersion characteristics to each respective driver combination being mounted to the invention.

The current invention is capable of being operated in a free-standing manner or optionally mounted in a cabinet or enclosure. The current invention is scalable as desired. The invention can be used in a variety of acoustic applications, and is highly adaptable to cosmetic and economic goals. The present invention can be manufactured in various materials and methodologies, such as wood panel construction, casting, or other methodologies.

DESCRIPTION OF THE INVENTION

Figure 1:
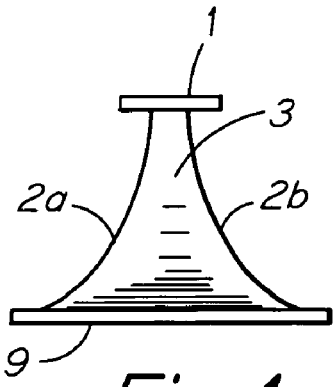
FIG. 1 is a top elevation view of the preferred embodiment of the invention.

The present invention comprises a single horn structure essentially embodying a midrange horn and a high frequency horn, one on top of the other, each respective horn having a separate throat opening integrated into a single rearwardly located driver mounting plate 1 and sharing the same horn sidewalls 2 and horn terminus 9. The tractrix expansion rate is preferred due to its quality of high fidelity reproduction, relatively compact size for a given Fc, propagation characteristics, and ability to propagate high frequencies with a minimum of high frequency "beaming". It should be noted that while the use of the tractrix terminal expansion curve is preferred for the horn component of the invention, virtually any horn expansion formula or mix of formulas can be used as long as the terminal side wall angles tend to follow the same vertical plane. The current invention is intended to be used in conjunction with a low frequency unit, and the low frequency cutoff (Fc) of the midrange horn component of the invention shown in the drawings is approximately 400 Hz, and the high frequency limit of the device is determined by the capabilities of the driver employed.

Referring to FIG. 1, the present invention preferred embodiment is disclosed as seen from the top. The tractrix horn body employs the same sidewall channel boundaries 2*a*, 2*b* to encloses two separate horn throats and two vertically expanding horns respective of each throat opening 7, 8 forming an expanding column of air which proceeds with different expansion rates from the respective throat opening 7, 8 best seen in FIGS. 2 and 3 to the horn terminus (or mouth) 9. The disclosed drawings represent the invention being constructed from wood although other materials and methodologies could be used, such as resin or plastic casting and the like. The dividing horizontal element 5 is shown in the drawings (except FIG. 1) as being constructed as a solid structural element, such as shaped solid wood, however, it will be realized that the same essential outside curve or surface can be obtained with other construction techniques and/or materials.

Figure 2:
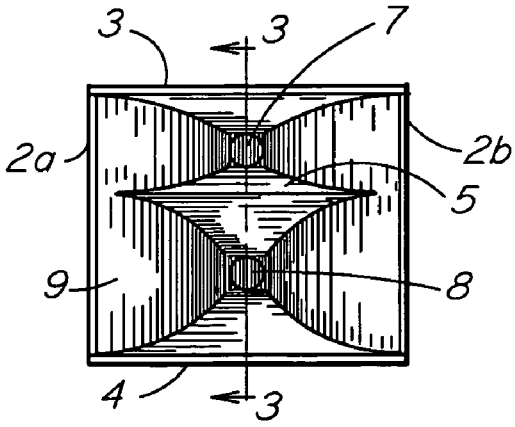
FIG. 2 is a front elevation view of the preferred embodiment of the invention.

FIG. 2 shows the invention as viewed from the front where the horizontal dividing element 5 is best disclosed. The horizontal dividing element serves to separate the two horn flares as well as controlling the respective vertical flare rates employed in combination with the horn body sidewalls 2, and the top 3 and bottom 4 horn baffles. Due to the disparate sizes of a typical midrange driver compared to the typical high frequency driver, accompanied by the weight of the typical midrange driver, the midrange horn and driver are arranged at the bottom of the invention. In the present disclosure, both throat openings 7, 8 are the same size, the preferred diameter of two inches being shown in the drawings.

Figure 3:
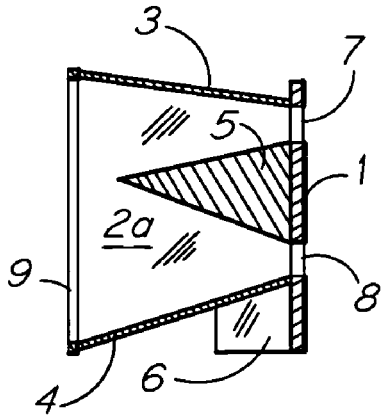
FIG. 3 is a side elevation view of the preferred embodiment of the invention.

FIG. 3 discloses a side view of the preferred embodiment derived from line 3-3 of FIG. 2. Due to the nature of the current invention and its use being most likely that of being placed on top of a low frequency cabinet of some sort, the vertical dispersion pattern of the invention is not considered as critical as the horizontal dispersion.

Figure 4:
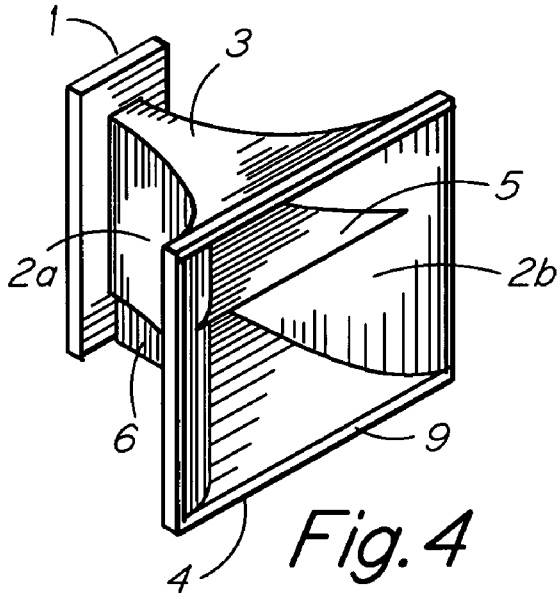
FIG. 4 is a perspective view of the preferred embodiment of the invention.

FIGS. 2, 3, and 4 disclose the optional stand-like vertical support 6 attached to the horn body and throat opening panel 1 structure which are dependent on the particular use and may or may not be needed in some applications. The preferred embodiment does not include a front-mounting flange or frame structure as do most prior art horns which are intended to be mounted to flat baffles. The addition of a vertical stand support 6 allows for free-standing use and reduces the requirements of attachment strength needed for enclosed applications. The optional vertical supports 6 also tend to reduce horn wall vibration of the horn lower element 4.

Whereas this disclosure depicts one specific type of manufacture, such as wood multiple-ply panels, it should not be limited to materials and processes that utilize only straight planar elements, such as plywood and the like. The current invention is capable of being manufactured by other methods and materials such as resin-type or plastic casting and the like.

While in accordance with the provisions of the Patent Statutes, the preferred forms and embodiments have been illustrated and described, it will become apparent to those skilled in the art that various changes and modifications may be made without deviating from the inventive concepts set forth above.

I claim:

1. In a loudspeaker horn combining a middle and high frequency range, a straight pathway horn body having two throat sections vertically arranged inline and located rearwardly, and two vertical side walls employing a horizontal expansion rate resulting in said side walls terminating in a front plane substantially perpendicular to the horn pathway axis, and partially forming a mouth therewith, said horn mouth and said horizontal expansion rate being proportioned primarily for horizontal dispersion, and further having an internal baffle arranged substantially horizontally between said throat openings, said baffle comprising an differentiating upward angled surface and a differentiating downward angled surface thereby forming two separate and unequal flare rates and pathway volumes within said horn body, said one respective flare rate being optimized for the propagation of high frequencies and thereby forming a smaller volume and said other flare rate being optimized for relatively lower range of frequencies and thereby forming a larger volume, said baffle upward and lower angled surfaces each further comprising unequal respective surface lengths progressing without acoustically significant interruption from approximately the said front plane and terminating rearwardly in a parallel spaced horizontal plane from said front plane, forming a continuous separating baffle between said throat openings, said angled baffle partially defining the respective vertical expansion rates of said two flaring volumes, said angled baffle further dividing said axial pathway equally at the said throat end of said horn body and unequally dividing said pathway at the said mouth end thereof, means for completing said horn body and said horn mouth, and means for standing said loudspeaker horn upon a flat surface.

2. In a loudspeaker horn as set forth in claim 1, wherein said horn body completing means includes top and bottom planar elements arranged in sealed engagement with said side horn walls, completing said horn body and said horn mouth.

3. In a horn type loudspeaker as set forth in claim 1, wherein said horn body completing means includes a rearwardly located vertically arranged panel wherein said throat openings are disposed, arranged perpendicular to said axial pathway, in sealed relation with said horn body and said throat sections, and adapted for the sealed engagement of a horn driver for each said throat opening.

4. In a horn type loudspeaker as set forth in claim 1, wherein said standing means includes at least one vertically aligned support element attached to the underside of said horn body.

5. An improved horn loudspeaker body wherein the improvement comprises:

a midrange horn combined with a high frequency horn which use the same structural sidewalls for each respective horn, and share a unitary horn terminus, said vertical horn flares of both horn sections being separated and partially defined by an asymmetrically shaped separating baffle which is substantially wedge shaped in the vertical plane as determined by the distance between two throat openings at the respective throats and decreases in vertical measurement along the axial pathway of said horn body and as determined by the horizontal expansion of said sidewalls, said baffle terminating proximate to said terminus thereby defining an axially-tangential vertical offset from a horizontal axial plane when said horizontal plane is equally arranged between said throat openings.

6. A loudspeaker horn assembly for an extended frequency response, comprising:

two oppositely flaring side walls terminating in a substantially perpendicular plane to the axial pathway, with said terminating plane being frontally disposed, a top panel and a bottom panel, an internal substantially horizontal baffle element arranged to form an internal flaring boundary, arranged to asymmetrically separate said horn structure into two unequal horn sections, each said section sized as determined by frequency which terminates towards the front of the horn, forming the upper and lower vertical flares of two separate said horn sections each defining different flare rates arranged one on top of the other, said upper and lower flares comprising different angles, said angles further arranged to converge substantially proximate to said terminating plane, the throat sections of which are separated in a vertical plane by substantially the distance required to mount two horn driving units axially arranged to said horn pathway, said flaring side walls being engaged in sealed relation with said horizontal baffle element and thereby forming a substantially continuous surface from the said throat sections of said horn structure and ending substantially proximate to the said terminating frontal plane.

7. A loudspeaker horn assembly as set forth in claim 6, wherein said throat sections are engaged in sealed relation with a vertically arranged and apertured panel adapted to be closed by two horn driving units.

8. A loudspeaker horn assembly as set forth in claim 6, wherein said unequal horn sections respective flare rates are further defined by said upper and lower vertical flares of said horizontal baffle element.

9. A loudspeaker horn assembly as set forth in claim 8, wherein said horn section flare rates are further defined by the angles of said top and bottom panels.

10. An acoustic horn for a wide frequency range, comprising:

a rectangular mouth formed by two side baffles and a top and bottom baffle, said baffles adapted and arranged to form a tapered horn axial pathway which decreases in cross-sectional area traveling axially from said mouth to two throat cavity openings oppositely disposed in a spaced parallel plane from said mouth, thereby forming a throat section, said throat cavity openings being acoustically separated by a substantially horizontally arranged baffle element adapted to form the bottom of a horn channel and the top of another horn channel formed below said baffle element and above said bottom baffle, said baffle upper and lower surfaces comprising two different angles and including different surface lengths thereby defining separate flare rates of said channels, said surfaces thereby defining a vertical offset of said baffle relative to a horizontal plane, said angles being further arranged to substantially conjoin proximate to said mouth, said horizontal baffle further asymmetrically defining two different flaring horn channels, each said channels having a different volume and different low frequency cut-off values, said mouth being substantially divided unequally therewith, said throat cavity openings being vertically arranged on a baffle engaged in sealed relation to said horn baffles at said throat section, said vertical baffle being arranged perpendicular to said axial pathway and being further adapted to be closed by at least two horn drivers.

* * * * *